United States Patent [19]

Muller-Girard

[11] Patent Number: 4,511,083

[45] Date of Patent: Apr. 16, 1985

[54] SELF-REGULATING HYDRANT

[75] Inventor: Otto Muller-Girard, Rochester, N.Y.

[73] Assignee: Ratnik Industries, Inc., Victor, N.Y.

[21] Appl. No.: 494,968

[22] Filed: May 16, 1983

[51] Int. Cl.[3] ..... F25C 3/04

[52] U.S. Cl. ..... 239/14; 137/79; 236/102; 239/75

[58] Field of Search ..... 239/25, 14, 75; 236/43, 236/102; 137/79

[56] References Cited

U.S. PATENT DOCUMENTS

| | | | |
|---|---|---|---|
| 1,881,637 | 10/1932 | Johnson | 236/102 X |
| 2,067,346 | 1/1937 | Rovinsky | 137/79 |
| 2,107,673 | 2/1938 | Lovekin | 236/102 X |
| 2,676,471 | 4/1954 | Pierce, Jr. | 239/2.5 |
| 3,270,460 | 9/1966 | Wild | 239/2 R X |
| 3,456,722 | 7/1969 | Cornelius | 137/79 X |
| 3,494,559 | 2/1970 | Skinner | 239/2.5 |
| 4,209,065 | 6/1980 | Ledent | 137/79 X |
| 4,437,481 | 3/1984 | Chamberlin et al. | 137/79 X |

*Primary Examiner*—Andres Kashnikow

*Attorney, Agent, or Firm*—Warren W. Kurz

[57] ABSTRACT

Disclosed herein is a self-regulating hydrant which is characterized by a mechanism which automatically alters the flow of fluid through a valve seat in response to changes in ambient temperature. A temperature-responsive member, operatively coupled to a valve plug, is used to control the position of the plug relative to a valve seat. As the temperature of such member changes, its dimensions change. Such dimensional changes are preferably amplified and used to move the plug relative to the valve seat to control the rate of fluid flow through the valve seat.

12 Claims, 10 Drawing Figures

SELF-REGULATING HYDRANT

This invention relates to self-regulating hydrants and, more particularly, to hydrants which automatically regulate fluid flow in response to changes in ambient air temperature. Though not so limited in use, the self-regulating hydrant of the invention is particularly well suited for use in an artificial snow-making operation for automatically controlling the flow of water used in such operation.

To assure an abundance of snow for their winter patrons, many ski resorts have invested in artificial snow-making equipment. Such equipment generally includes one or more nozzles, sometimes referred to as "snow guns", which produce snow by combining water and compressed air in certain proportions and under certain conditions. See, for example, the disclosures of U.S. Pat. Nos. 3,829,013 and 3,494,559. The consistency (e.g. wetness) of the artificial snow produced by such equipment depends, in large part, on ambient air temperature. In general, as the ambient air temperature rises, less water is required to produce snow of nominal consistency.

Heretofore it has been common to require operators of snow-making equipment to monitor gradual changes in ambient air temperature and to manually adjust the flow of water through a water hydrant to maintain the desired snow consistency. Inasmuch as artificial snow-making is often an around-the-clock operation and the equipment can be scattered over an entire mountainside, it is desirable to minimize such operator involvement and to automate the snow-making operation to the maximum extent.

Now, in accordance with the invention, there is provided a self-regulating hydrant which, in response to changes in ambient air temperature, automatically varies the flow of a fluid passing therethrough. The hydrant of the invention basically comprises a pair of elongated housings which, preferably, are concentrically arranged with respect to a common central axis. The inner housing includes means defining a valve seat and outlet through which fluid can enter and exit from such housing, respectively. A plug cooperates with the valve seat for controlling the flow of fluid into the inner housing, and means are provided for adjusting the position of the plug relative to the valve seat to provide an initial predetermined flow of fluid into the inner housing. The outer housing is exposed to the ambient air temperature and is made of a material which exhibits a relatively high coefficient of linear thermal expansion. The outer housing is operatively connected to the plug via a linking mechanism which varies the position of the plug relative to the valve seat in response to changes in dimension (e.g. length) of the outer housing, as occasioned by changes in ambient air temperature. Preferably, the inner and outer members are thermally isolated from each other to prevent the temperature of the fluid within the inner housing from influencing the expansion or contraction of the outer housing. Preferably, the linking means is in the form of a displacement amplifying mechanism (e.g. a beam system) which converts relatively small changes in dimension of the outer housing to substantially greater movements of the plug relative to the valve seat.

The invention and its various advantages over the prior art will be better understood from the ensuing detailed description of a preferred embodiment, reference being made to the accompanying drawings in which.

FIGS. *3a, 3b, 4a, 4b, 5a, 5b, 6a* and *6b* illustrate top (or bottom) and cross-sectional views of various components of the beam system comprising the preferred embodiment of the invention.

Figure 1:
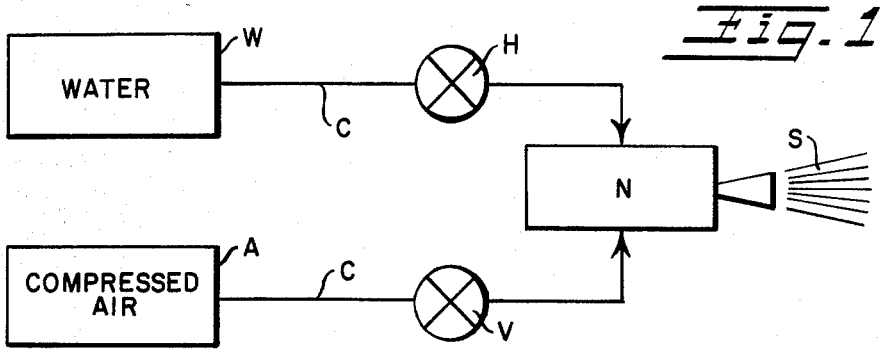
FIG. 1 is a schematic illustration of snow-making apparatus in which the present invention can be embodied.

Referring now to FIG. 1, there is shown the basic components of an artificial snow-making system. Basically, such a system comprises a source of water W and a source of compressed air A, both being connected through suitable conduits C to a nozzle N which serves to mix the water and compressed air it receives to produce artificial snow. A hydrant H serves to regulate the flow of water to the nozzle, and a valve V functions to regulate the flow of compressed air. As indicated above, the consistency of the artificial snow produced by nozzle N is dependent, in large part, on the atmospheric conditions prevailing at the time, particularly ambient air temperature and humidity. For nominal settings for the hydrant H and valve V, the wetness of the artificial snow will increase dramatically with increasing ambient temperature. Thus, to maintain a desired wetness, it is necessary to vary either the rate of flow of water through hydrant H or, alternatively, the flow of compressed air through valve V.

Figure 2:
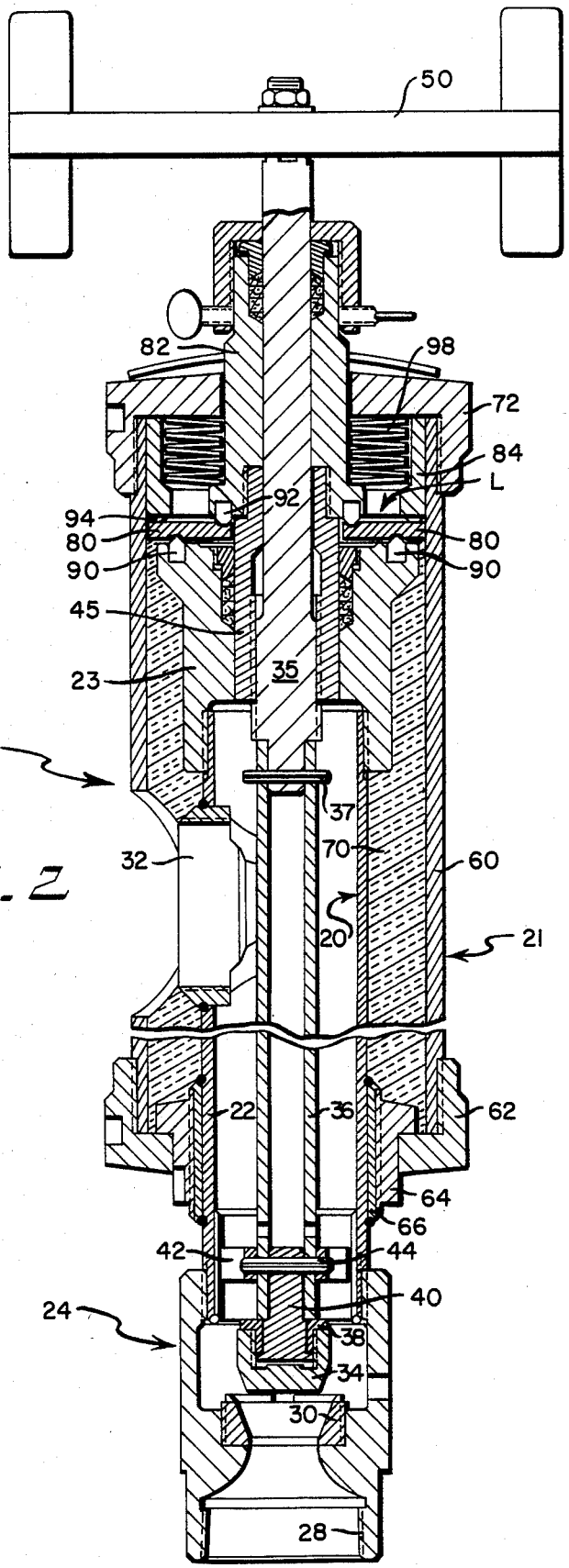
FIG. 2 is a cross-sectional view of a self-regulating hydrant structured in accordance with a preferred embodiment of the invention.

Now in accordance with the present invention, hydrant H is of a self-regulating design; i.e., a design by which the hydrant automatically adjusts the flow of water therethrough in accordance with the instantaneous ambient air temperature. Referring to the cross sectional illustration of FIG. 2, hydrant H basically comprises an inner housing 20, an outer housing 21, and a linking assembly L. As will become apparent from the detailed description to follow, the inner housing functions to receive water, and the outer housing controls, via the linking assembly A, the rate at which the inner housing receives water as a function of ambient air temperature.

Inner housing 20 comprises a steel riser pipe 22 to which a valve seat assembly 24 is threaded at its lower end. The valve seat assembly 24 controls the flow of water into housing 20. Threaded to the upper end of riser pipe 22 is a pivot sleeve 23 which forms part of the linking assembly L, discussed below.

The valve seat assembly 24 comprises a threaded inlet 28 which communicates with a valve seat 30. The flow rate of water into the interior of housing 20 through the valve seat 30 is controlled by a plug 34 which is operatively connected to a valve stem 35 via an extension tube 36. A spring pin 37 serves to connect the extension tube to the valve stem. Plug 34 is threaded to the outer surface of a lock nut 38 which, in turn, is supported by a disc adapter 40 protruding from the lower end of the extension tube 36. The lower end of extension tube 36 is concentrically maintained with respect to housing 20 by a spider assembly 42 which is connected to extension tube 36 via spring pin 44. This spring pin also functions to prevent the disc adapter from moving relative to the extension tube.

Valve stem 35 is threaded into an inner sleeve member 45 which is press fit into the pivot sleeve 23 carried by riser pipe 22. As valve stem 35 is rotated by its handle 50, it advances vertically within the inner sleeve 45, thereby moving plug 34 relative to the valve seat 30. As explained below, the initial flow rate through the hydrant is regulated by rotating the valve stem to remove plug 34 from engagement with the valve seat 30 into a position in which it produces a desired flow rate through outlet 32 formed in housing 20.

Now, in order to automatically vary the position of plug 34 relative to valve seat 30 in response to changes in ambient air temperature, there is provided, in accordance with the present invention, an expandable outer housing 21, which is adapted to be exposed to ambient air temperature during hydrant operation, and a linking assembly L which converts relatively small dimensional changes of the housing 21, as occasioned by ambient air temperature changes, to relatively large movements of plug 34. As shown, housing 21 is preferably in the form of a tube 60 which is concentrically arranged with respect to the valve stem 35 and riser pipe 22. Tube 60 is made of a material having a relatively large coefficient of linear thermal expansion. A particularly preferred material is an aluminum copper alloy which exhibits a coefficient of about $22.4\times10^{-6}$ cm/cm−°C. Other suitable materials include commercial brass, bronze, magnesium and copper which have coefficients of thermal expansion ranging from about 17 to $24\times10^{-6}$ cm/cm−°C. Expansion tube 60 is attached at the base of the hydrant via a threaded bottom cap 62 which engages the shoulder of an adjustment ring 64, the latter being threaded on a sleeve 66 welded to the outside of riser pipe 22. To assure that the ambient air temperature is the principle influence on the length of the expansion member 60, a layer of thermal insulation 70 is positioned between the expansion tube and the riser pipe. This layer of thermal insulation may comprise, for example, closed cell urethane. A top cap 72 is threaded to the upper portion of the expansion tube, as shown.

Figure 3A:
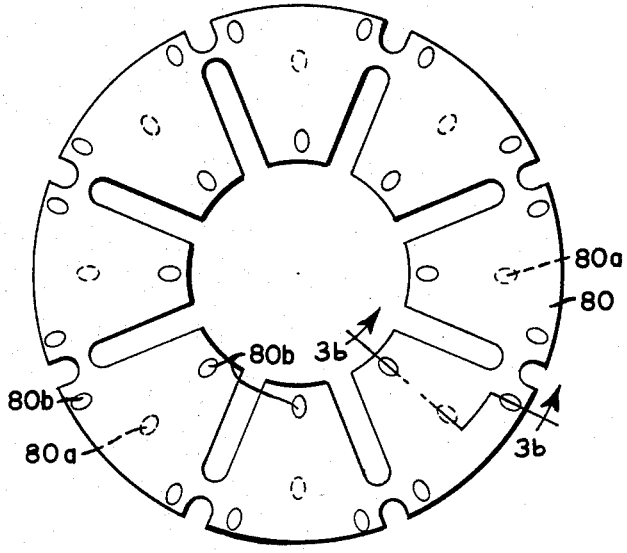
Figure 4A:
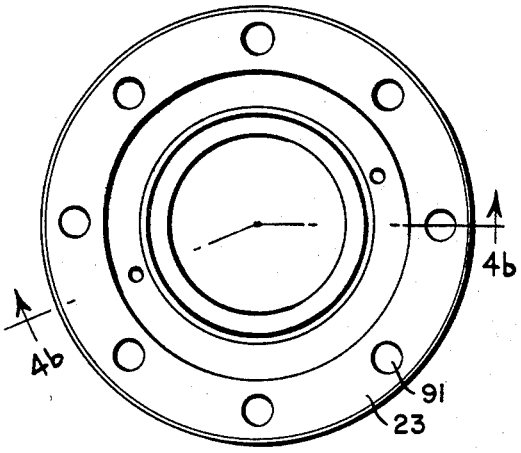
Figure 3B:
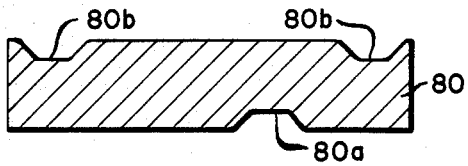
Figure 4B:
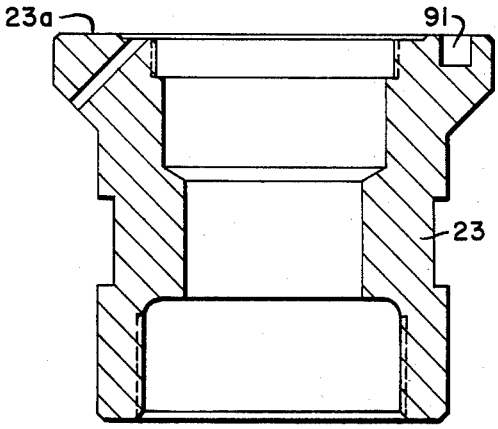
Figure 5A:
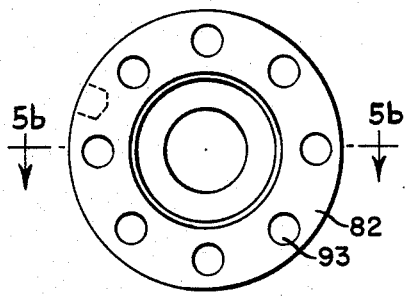
Figure 6A:
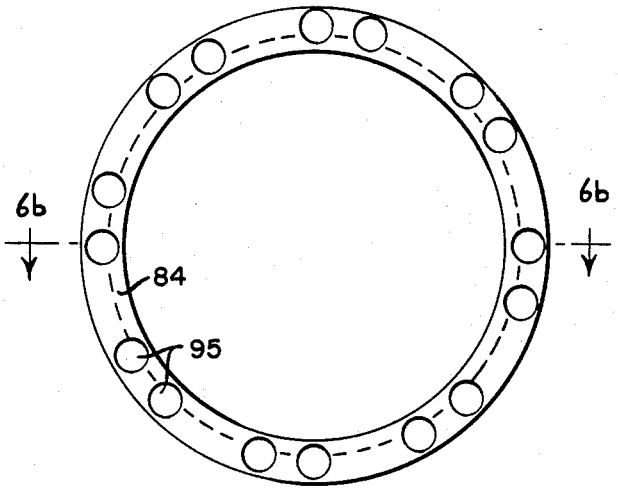
Figure 5B:
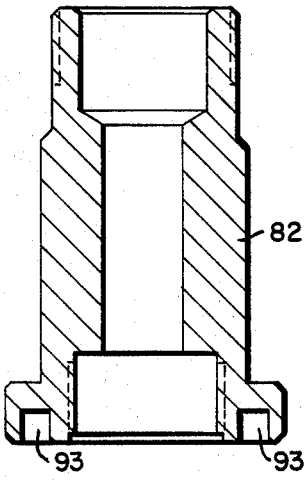
Figure 6B:
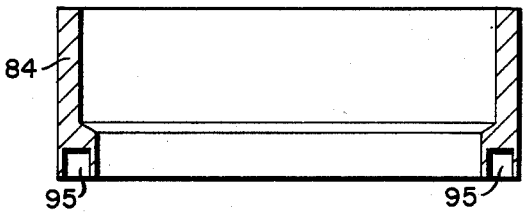

As regards the structural details of the above-mentioned linking assembly L, it preferably comprises a beam system which includes a fulcrum disc 80 (shown in FIGS. 3*a* and 3*b*), pivot sleeve 23 (shown in FIGS. 4*a* and 4*b*), inner sleeve 82 (shown in FIGS. 5*a* and 5*b*), and outer sleeve 84 (shown in FIGS. 6*a* and 6*b*). The outer sleeve 84 is slip fitted into the upper end of tube 60, and inner sleeve 82 is threaded to and supported by the upper end of member 45. A plurality of pivot pins 90 (e.g. eight in number) protruding from a like plurality of bore holes 91 formed in the upper surface 23*a* of pivot sleeve 23 support the fulcrum disc 80 by engaging indentations 80*a* formed in the bottom surface thereof. (See FIGS. 3*a* and 3*b*). Similarly shaped pivot pins 92 and 94 protruding from bore holes 93 and 95 formed in the bottom surfaces of inner and outer sleeves 82 and 84, respectively, engage indentations 80*b* formed in the upper surface of fulcrum disc 80. (See FIGS. 5*a*, 5*b*, 6*a* and 6*b*). A plurality of Belleville spring washers 98 are positioned between top cap 72 and shoulder surfaces of inner sleeve 82 to exert a downward force on this member to maintain the components in the positions shown in FIG. 2. The spring force applied by washers 98 is such as to prevent the water pressure acting on plug 34 from causing the plug to become unseated when the valve stem is rotated to a position to normally seat the plug (i.e. close the valve).

In operation, handle 50 is rotated to position plug 34 in a position to produce a desired flow rate for a given air temperature. Thereafter, as the air temperature increases, for example, tube 60 expands in length and outer sleeve 84 reduces the force applied on the outer periphery of disc 80. When this occurs, spring washers 98 cause the fulcrum disc to pivot about pins 90 so that plug 34 is urged into engagement with valve seat 30, thereby reducing the flow rate through the hydrant. This is advantageous because, in snow making, the ratio of water to air should be reduced with increasing temperature. Conversely, as the ambient air temperature falls, tube 60 will shrink in length, causing sleeve 84 to move downward. This movement causes sleeve 82 to move upward, thereby disengaging plug 34 from the valve seat.

It should be noted that the Belleville washer assemblies also function to protect the valve against temperature induced self-destruction. For example, when the valve has been closed manually (by rotating handle 50) and the temperature thereafter increases, there is a tendency for the linking assembly to drive the plug deeper into the valve seat. But this eventuality cannot materialize because, as the tube 60 grows in length, outer sleeve 84 detaches itself from the fulcrum disc, causing a final valve seating force which is determined by the Belleville washer assembly.

While the invention has been described with particular reference to a preferred embodiment, it will be apparent that various modifications can be made without departing from the spirit and scope of the invention as defined by the accompanying claims.

I claim:

1. Self-adjusting hydrant for automatically varying the flow of a fluid in response to changes in ambient air temperature, said hydrant comprising:

(a) a first housing including means defining (i) a valve seat through which a fluid can enter said housing and (ii) an outlet through which a fluid within said housing can exit therefrom;

(b) a plug adapted to cooperate with the said valve seat for controlling the flow of fluid into said housing through said seat;

(c) means for adjusting the position of said plug relative to said seat to provide an initial predetermined flow of fluid into said housing;

(d) a second housing substantially surrounding said first housing, said second housing being adapted to change in at least one dimension in response to changes in ambient air temperature; and (e) linking means operatively coupling said second housing and said plug for varying the position of said plug relative to said valve seat in response to dimensional changes in said second housing as occasioned by changes in ambient air temperature.

2. The invention as defined by claim 1 wherein said linking means comprises means for displacing said plug relative to said valve seat by a distance greater than the dimensional changes of said second housing.

3. The invention as defined by claim 2 wherein said linking means comprises a beam system including a lever and fulcrum.

4. The invention as defined by claim 1 wherein said second housing is substantially concentrically arranged with respect to said first housing.

5. The invention as defined by claim 1 further comprising means for thermally insulating said second housing from said fluid, whereby the dimensions of said second housing are substantially independent of fluid temperature.

6. The invention as defined by claim 1 further comprising spring means for urging said plug toward engagement with said valve seat, said spring means exerting a force which is sufficient to overcome the pressure of fluid entering said first housing through said valve seat.

7. The invention as defined by claim 6 wherein said spring means comprises a plurality of Belleville washers.

8. The invention as defined by claim 1 wherein said thermal insulating means comprises closed cell urethane insulation.

9. The invention as defined by claim 1 wherein said second housing comprises aluminum.

10. In snow-making apparatus comprising a source of compressed air, a source of pressurized water, a nozzle for combining compressed air and pressurized water to produce artificial snow and a water hydrant for controlling the flow of water to the nozzel to vary the air/water ratio within such nozzel, the improvement wherein said water hydrant comprises:

means defining a valve seat operatively coupled to said water source, a plug adapted to cooperate with said seat for controlling the flow of water through said valve seat;

means operatively coupled to said plug, for varying the position of said plug relative to said seat;

an elongated member which is adapted to change in length in response to changes in ambient air temperature; and linking means coupling said plug and said elongated member for displacing said plug relative to said seat by a distance which is greater than that change in length of the elongated member effected by a change in ambient air temperature.

11. The invention as defined in claim 10 wherein said linking means comprises a lever and fulcrum arrangement.

12. The invention as defined by claim 10 further comprising means for thermally insulating said elongated member from the water flowing through said valve seat to minimize the effect of water temperature on the length of said elongated member.

* * * * *